US010319485B2

(12) United States Patent
Sugita et al.

(10) Patent No.: US 10,319,485 B2
(45) Date of Patent: Jun. 11, 2019

(54) RADIOPROTECTIVE UNWOVEN FABRIC AND FIBER PRODUCT

(71) Applicant: PANASONIC INTELLECTUAL PROPERTY MANAGEMENT CO., LTD., Osaka (JP)

(72) Inventors: Kazushige Sugita, Hyogo (JP); Masahiro Matsumoto, Osaka (JP); Tomohiro Kanazawa, Osaka (JP); Tsuyoshi Terada, Osaka (JP)

(73) Assignee: PANASONIC INTELLECTUAL PROPERTY MANAGEMENT CO, LTD., Osaka (JP)

( * ) Notice: Subject to any disclaimer, the term of this patent is extended or adjusted under 35 U.S.C. 154(b) by 0 days.

(21) Appl. No.: 15/793,744

(22) Filed: Oct. 25, 2017

(65) Prior Publication Data

US 2018/0130563 A1 May 10, 2018

(30) Foreign Application Priority Data

Nov. 4, 2016 (JP) ..... 2016-216664

(51) Int. Cl.

| | |
|---|---|
| ***G21F 3/02*** | (2006.01) |
| ***G21F 1/08*** | (2006.01) |
| ***G21F 1/12*** | (2006.01) |

(52) U.S. Cl.
CPC ..... *G21F 3/02* (2013.01); *G21F 1/08* (2013.01); *G21F 1/125* (2013.01)

(58) Field of Classification Search
USPC ..... 250/516, 516.1
See application file for complete search history.

(56) References Cited

U.S. PATENT DOCUMENTS 5,081,455 A * 1/1992 Inui ..... H01Q 17/002 342/1
6,674,087 B2 * 1/2004 Cadwalader ..... G21F 1/103 128/849

FOREIGN PATENT DOCUMENTS

JP 2015-206643 A 11/2015

* cited by examiner

*Primary Examiner* — Phillip A Johnston
(74) *Attorney, Agent, or Firm* — McDermott Will & Emery LLP

(57) ABSTRACT

A radioprotective unwoven fabric is a sheet in which metal fibers are three-dimensionally and randomly stacked, the metal fibers each comprising a metal material having a specific gravity higher than a specific gravity of lead. The metal fibers may comprise a tungsten wire.

14 Claims, 5 Drawing Sheets

RADIOPROTECTIVE UNWOVEN FABRIC AND FIBER PRODUCT

CROSS REFERENCE TO RELATED APPLICATION

This application claims the benefit of priority of Japanese Patent Application Number 2016-216664 filed on Nov. 4, 2016, the entire content of which is hereby incorporated by reference.

BACKGROUND

1. Technical Field

The present disclosure relates to a radioprotective unwoven fabric and a fiber product including the radioprotective unwoven fabric.

2. Description of the Related Art

Radioactive rays (e.g., Y rays and X rays) are emitted from radioactive materials and other materials in medical radiotherapy facilities, nuclear power plants, or the like. For this reason, to provide radioprotection, radioprotective items including a material shielding radioactive rays have been used in environments in which radioactive rays are emitted.

Conventionally, lead has been used as a material shielding radioactive rays. A lead plate, a lead evaporation sheet on which lead is deposited by an evaporation method, or the like is known as a radioprotective item including lead. For example, Patent Literature (PTL) 1 (Japanese Unexamined Patent Application Publication No. 2015-206643) discloses a radiation shielding sheet including sheet-like lead.

SUMMARY

A radioprotective item including lead is heavy because the radioprotective item needs a sufficient thickness to achieve desired radioprotective effectiveness, or a radioprotective item including lead cannot be used in a place having a high temperature because the radioprotective item has a low melting point.

In particular, a lead plate is difficult to cut or process or is damaged when bent because the lead plate is hard and unpliable. A lead evaporation sheet is damaged by a fold being exfoliated when bent.

The present disclosure has an object to provide a radioprotective unwoven fabric and a fiber product which have superior radioprotective effectiveness and yet are not damaged when folded.

In order to achieve the above object, a radioprotective unwoven fabric according to one aspect of the present disclosure is a sheet in which metal fibers are three-dimensionally and randomly stacked, the metal fibers each comprising a metal material having a specific gravity higher than a specific gravity of lead.

Moreover, a fiber product according to one aspect of the present disclosure is obtained by sewing the radioprotective unwoven fabric.

The present disclosure makes it possible to provide, for example, a radioprotective unwoven fabric and a fiber product which have superior radioprotective effectiveness and yet are not damaged when folded.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, embodiments of the present disclosure will be described with reference to the drawings. It should be noted that each of the subsequently described embodiments shows a specific example. Therefore, numerical values, shapes, materials, structural components, the arrangement and connection of the structural components, etc. shown in the following embodiments are mere examples, and are not intended to limit the scope of the present disclosure. Moreover, among the structural components in the following embodiments, structural components not recited in any one of the independent claims which indicate the broadest concepts of the present invention are described as optional structural components. Furthermore, the figures are schematic diagrams and are not necessarily precise illustrations.

Embodiment 1

Figure 1:
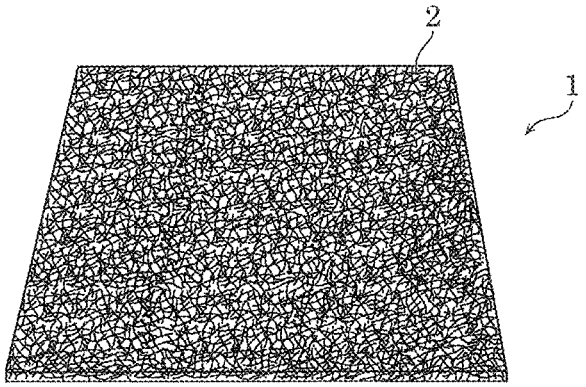
FIG. 1 is a perspective view illustrating a radioprotective unwoven fabric according to Embodiment 1.
Figure 2:
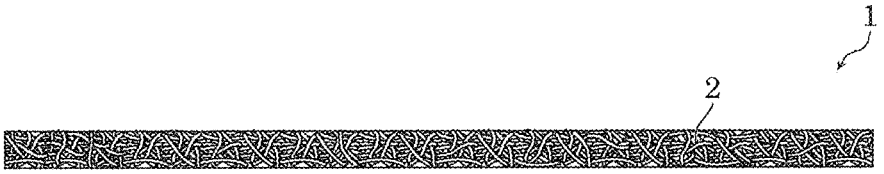
FIG. 2 is a cross-sectional view illustrating the radioprotective unwoven fabric according to Embodiment 1.

First, radioprotective unwoven fabric 1 according to Embodiment 1 will be described with reference to FIG. 1 and FIG. 2. FIG. 1 is a perspective view illustrating radioprotective unwoven fabric 1 according to Embodiment 1. FIG. 2 is a cross-sectional view illustrating radioprotective unwoven fabric 1 according to Embodiment 1.

As illustrated in FIG. 1 and FIG. 2, radioprotective unwoven fabric 1 according to Embodiment 1 is a sheet having radioprotective effectiveness for shielding radioactive rays. In other words, radioprotective unwoven fabric 1 shields radioactive rays by blocking (completely shielding) or attenuating the radioactive rays. Radioprotective unwoven fabric 1 has a thickness of, for example, 5 to 20 mm, but is not limited to this thickness.

Radioprotective unwoven fabric 1 according to Embodiment 1 is felt and a cloth-like sheet having flexibility. Accordingly, radioprotective unwoven fabric 1 can be folded like a cloth, and is not broken or chipped even when folded.

Radioprotective unwoven fabric 1 has a structure in which metal fibers 2 are three-dimensionally and randomly stacked. Specifically, metal fibers 2 are interlaced and compacted. In Embodiment 1, metal fibers 2 are bonded by being interlaced without using an adhesive including resin. In consequence, even when folded, radioprotective unwoven fabric 1 is not folded by plastic deformation of each metal fiber 2, and radioprotective unwoven fabric 1 as a whole is allowed to easily return to a pre-folded shape like a fabric.

Metal fibers 2 included in radioprotective unwoven fabric 1 each are a metal wire (metal wire material) including a metal material that is a shield material shielding radioactive rays and has a higher specific gravity than lead. Examples of the metal material having a higher specific gravity than lead include tungsten (W) and molybdenum (Mo). Such a metal material shields radioactive rays by absorbing the radioactive rays.

In Embodiment 1, metal fibers 2 included in radioprotective unwoven fabric 1 include a tungsten wire (tungsten fiber). Each of metal fibers 2 may be a single strand of a tungsten filament (tungsten wire) or a composite strand of tungsten filaments made by twisting or paralleling two or more strands of tungsten filaments. In other words, each metal fiber 2 may be a monofilament fiber or multifilament fiber.

Moreover, metal fibers 2 included in radioprotective unwoven fabric 1 may include a metal wire other than the tungsten wire, such as a molybdenum wire (molybdenum fiber). In this case, each of metal fibers 2 may be a composite strand made by twisting or paralleling a single strand of a tungsten filament and a metal wire of a different type, or may be a composite strand including a tungsten wire and a fiber other than a metal fiber (e.g., a chemical fiber).

In Embodiment 1, metal fibers 2 included in radioprotective unwoven fabric 1 are only tungsten wires. A tungsten wire comprises, for example, pure tungsten (at a purity greater than 99.00%), but the purity of the tungsten wire is not limited to this. In Embodiment 1, tungsten wires comprising tungsten at a purity as great as almost 100% are used as metal fibers 2.

Each metal fiber 2 is a ultrafine metal thin wire, and a diameter of metal fiber (metal wire) 2 is, for example, less than or equal to 1 mm. As an example, each metal fiber 2 has a diameter less than or equal to 150 μm, preferably less than or equal to 50 μm, still preferably less than or equal to 20 μm, or still further preferably less than or equal to 10 μm. In addition, each metal fiber 2 is a short fiber having a length of at least 10 mm and at most 100 mm. More preferably, metal fibers 2 having a length of at least 30 mm and at most 80 mm may be used.

Figure 3:
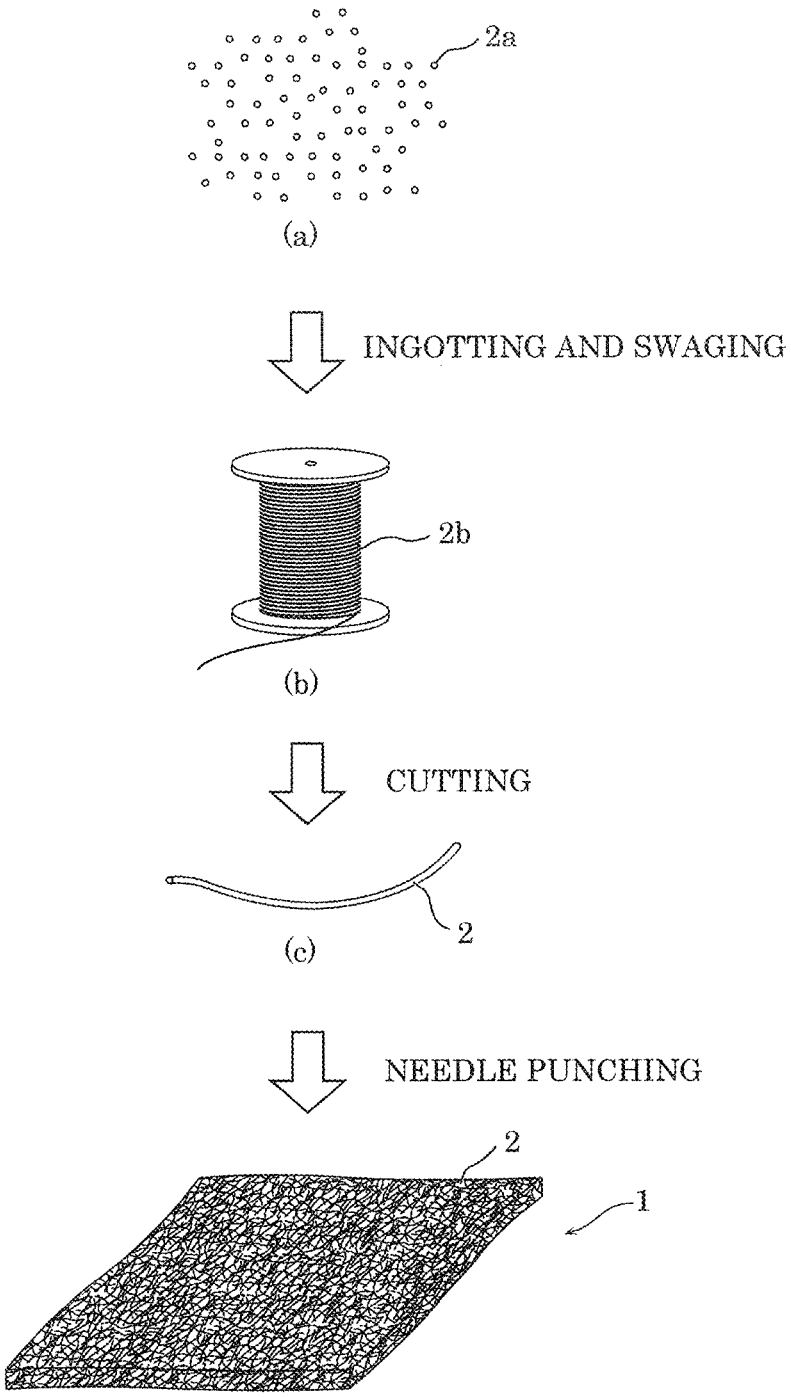
FIG. 3 is a diagram illustrating a method for producing a radioprotective unwoven fabric according to Embodiment 1.

Next, a method for producing radioprotective unwoven fabric 1 will be described with reference to FIG. 3. FIG. 3 is a diagram illustrating the method for producing radioprotective unwoven fabric 1 according to Embodiment 1.

First, metal fine particles 2*a* (metal powder) are prepared as illustrated in (a) of FIG. 3. Then, metal wire 2*b* is produced from metal fine particles 2*a* as illustrated in (b) of FIG. 3. Subsequently, metal wire 2*b* is cut to a predetermined length. Consequently, short metal fiber 2 can be produced as illustrated in (c) of FIG. 3.

For example, when tungsten wires are produced as metal fibers 2, tungsten fine particles (tungsten powder) having a particle diameter of approximately 5 μm are prepared as metal fine particles 2*a*. Next, these tungsten fine particles are press-molded and sintered to be a tungsten ingot. Then, the sintered body of the tungsten ingot is swaged into a wire by being press-forged from its periphery and extended. After that, the wire is plastically deformed by being repeatedly drawn (wire drawn) using drawing dies having gradually reduced pore sizes, and is wound, thereby producing metal wire 2*b* (tungsten wire). Subsequently, metal wire 2*b* is sequentially cut to a length of at least 20 mm and at most 80 mm, thereby producing many tungsten wires as metal fibers 2. In Embodiment 1, metal fibers 2 are produced by cutting metal wire 2*b* to a length of approximately 20 to 30 mm. In this case, metal fibers 2 each may be produced by being cut as a monofilament or not as a monofilament.

The tensile strength of the tungsten wires thus produced is increased as a result of work hardening by repeating drawing using dies in the process of making an ultrafine wire. In other words, the use of the tungsten wires makes it possible to obtain metal wires less likely to break even if the metal wires are made ultrafine. Moreover, although metal wires usually become more flexible with the increase in flexibility of the metal wires as a result of making the metal wires thinner, the tungsten wires become flexible when the diameter of the tungsten wires is approximately less than or equal to 100 μm.

Next, metal fibers 2 resulting from the cutting are three-dimensionally and randomly stacked into a sheet. In Embodiment 1, an unwoven fabric that is sheet-like is produced by needle punching metal fibers 2.

Figure 4:
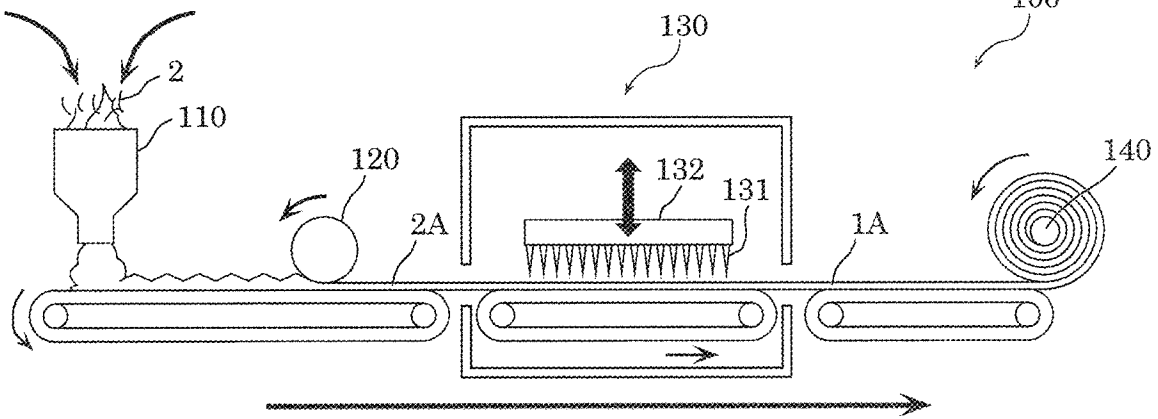
FIG. 4 is a diagram illustrating needle punching in the method for producing a radioprotective unwoven fabric according to Embodiment 1.

Hereinafter, a step of needle punching metal fibers 2 will be described in detail with reference to FIG. 4. FIG. 4 is a diagram illustrating the step of needle punching in the method for producing radioprotective unwoven fabric 1 according to Embodiment 1.

As illustrated in FIG. 4, needle punching machine 100 is capable of processing metal fibers 2 into an unwoven fabric.

Short metal fibers 2 are fed into feeder 110. Feeder 110 opens and stirs fed metal fibers 2 by flowing air, and supplies metal fibers 2 to a belt conveyor. Metal fibers 2 supplied to the belt conveyor are sent off in a certain amount by carding machine 120 etc. and supplied as web 2A to needle punching process machine 130.

Needle punch 132 provided with needles 131 compacts metal fibers 2 (web 2A) supplied to needle punching process machine 130 while interlacing metal fibers 2. Specifically, by causing needle punch 132 to continuously move up and down at a high speed, needles 131 of needle punch 132 repeatedly pierce metal fibers 2 (web 2A). Here, tiny barbs provided to needles 131 interlace metal fibers 2. Accordingly, unwoven fabric 1A that is sheet-like and felted is formed. It should be noted that needle punching may be performed on stacked metal fibers 2 (webs 2A) according to the purpose or intended use.

Elongated, sheet-like unwoven fabric 1A formed by needle punching process machine 130 is wound by wind-up roll 140. Subsequently, sheet-like radioprotective unwoven fabric 1 can be produced by drawing unwoven fabric 1A from wind-up roll 140 and cutting unwoven fabric 1A appropriately.

It should be noted that needle 131 of needle punching process machine 130 breaks easily during processing, and needle 131 may get mixed in unwoven fabric 1A. In this case, although when, instead of metal fibers, chemical fibers are needle punched, a metal detector is capable of detecting and removing broken needle 131, the metal detector is incapable of detecting broken needle 131 in unwoven fabric 1A including metal fibers 2. For this reason, broken needle 131 mixed in unwoven fabric 1A can be detected and removed by determining a type of metal based on the magnetic field distribution of needle punched unwoven fabric 1A.

Hereinafter, the advantageous effects of radioprotective unwoven fabric 1 according to Embodiment 1 will be described.

Figure 5:
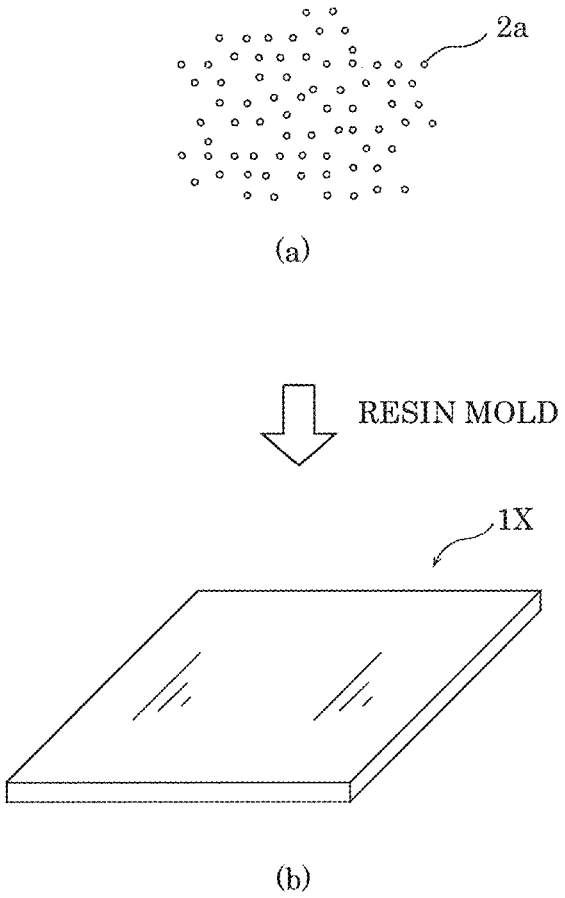
FIG. 5 is a diagram illustrating a method for producing a radioprotective sheet in which metal fine particles are molded with resin.

A configuration in which metal fine particles are molded with resin is conceivable as a radioprotective sheet including metal fine particles such as tungsten fine particles. Such a radioprotective sheet can be produced as illustrated in, for example, FIG. 5. FIG. 5 is a diagram illustrating a method for producing a radioprotective sheet in which metal fine particles are molded with resin.

Metal fine particles 2*a* such as tungsten fine particles are prepared as illustrated in (a) of FIG. 5. By molding metal fine particles 2*a* with resin and curing the resin, plate-like radioprotective sheet 1X can be produced as illustrated in (b) of FIG. 5.

Radioprotective sheet 1X thus produced has radioprotective effectiveness corresponding to the amount of metal fine particles 2*a* contained. Radioprotecive sheet 1X, however, is broken or chipped when folded because radioprotective sheet 1X has a structure in which metal fine particles 2*a* are dispersed inside the cured resin. Moreover, it is difficult to use radioprotective sheet 1X produced by molding metal fine particles 2*a* with resin in a high-temperature environment because the resin melts at high temperature.

In contrast, radioprotective unwoven fabric according to Embodiment 1 is a sheet in which metal fibers are three-dimensionally and randomly stacked, the metal fibers each comprising a metal material having a specific gravity higher than a specific gravity of lead.

Radioprotective unwoven fabric 1 thus configured has superior radioprotective effectiveness and yet is not broken or chipped even when folded. Accordingly, radioprotective unwoven fabric 1 can be sewn in the same manner as a woven fabric and a knit fabric, thereby making it easy to produce a fiber product having superior radioprotective effectiveness.

Examples of a fiber product made by sewing radioprotective unwoven fabric 1 include a garment, a hat, gloves, and a sheet. Examples of a garment include working clothes used in a working area and an ordinary garment such as a coat and pants, but the present disclosure is not limited to these examples. In particular, because radioprotective unwoven fabric 1 has the same texture as a cloth, radioprotective unwoven fabric 1 can be used for gloves, a product for around neck, etc. to give radioprotection to body parts of a person that are thin and require flexing.

Furthermore, because radioprotective unwoven fabric 1 includes no resin, radioprotective unwoven fabric 1 does not melt even if radioprotective unwoven fabric 1 is used in a high-temperature environment. In addition, radioprotective unwoven fabric 1 has high strength and high resistance to cutting because radioprotective unwoven fabric 1 has a structure in which metal fibers 2 are three-dimensionally stacked and interlaced. For this reason, radioprotective unwoven fabric 1 is less likely to break even a knife is put to radioprotective unwoven fabric 1, and thus it is possible to use radioprotective unwoven fabric 1 as padding etc. for stopping the rotation of an electric chainsaw.

Moreover, in radioprotective unwoven fabric 1 according to Embodiment 1, metal fibers 2 comprise a tungsten wire.

With this, it is possible to easily achieve radioprotective unwoven fabric 1 that has superior radioprotective effectiveness and yet is not damaged even when folded.

Moreover, in radioprotective unwoven fabric 1 according to Embodiment 1, each of metal fibers 2 has a diameter of at most 1 mm and a length of at least 20 mm and at most 80 mm.

With this, it is possible to easily produce radioprotective unwoven fabric 1 that has superior radioprotective effectiveness and yet is not damaged even when folded. by, for example, needle punching metal fibers 2.

Moreover, radioprotective unwoven fabric 1 according to Embodiment 1 is felt.

With this, because radioprotective unwoven fabric 1 can be used as felt, a fiber product can be produced in the same manner as a felt cloth, by performing a conventional sewing process on radioprotective unwoven fabric 1.

Embodiment 2

Figure 6:
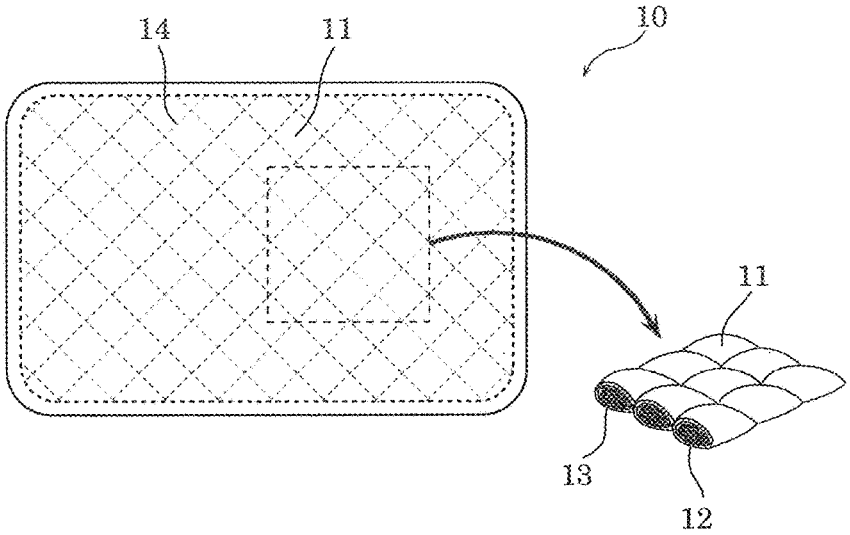
FIG. 6 is a plan view illustrating a radioprotective unwoven fabric according to Embodiment 2.
Figure 7:
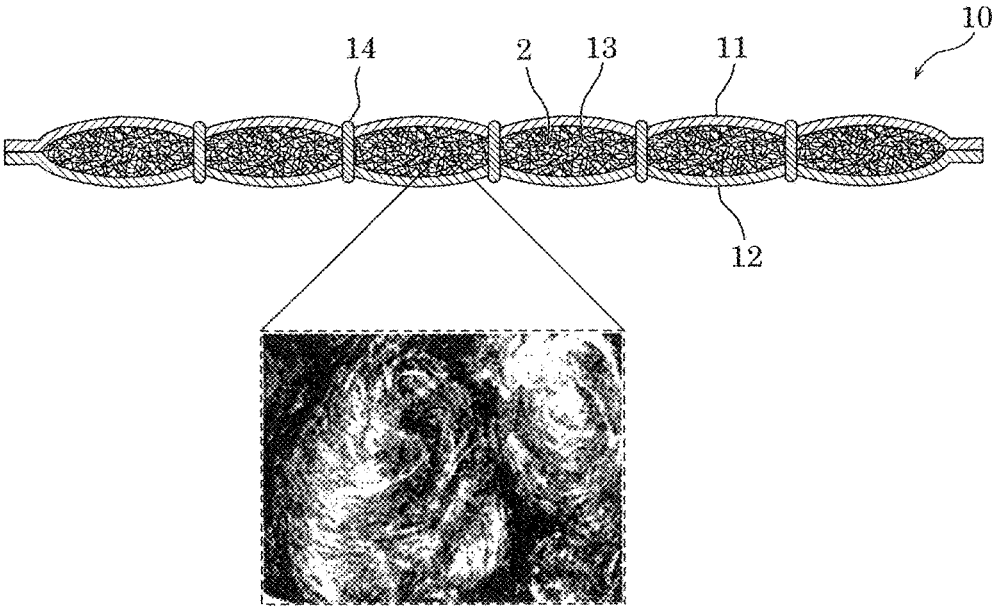
FIG. 7 is a cross-sectional view illustrating the radioprotective unwoven fabric according to Embodiment 2.

Hereinafter, radioprotective unwoven fabric 10 according to Embodiment 2 will be described with reference to FIG. 6 and FIG. 7. FIG. 6 is a plan view illustrating radioprotective unwoven fabric 10 according to Embodiment 2. FIG. 7 is a cross-sectional view illustrating radioprotective unwoven fabric 10 according to Embodiment 2.

In radioprotective unwoven fabric 10 according to Embodiment 2, metal fibers 2 are made woolly and packed. For example, in radioprotective unwoven fabric 10, woolly metal fibers 2 are innumerably and randomly spread all over. Examples of a shape of woolly metal fibers 2 include an S shape, an O shape, a C shape, and a curved shape.

As illustrated in FIG. 6 and FIG. 7, radioprotective unwoven fabric 10 according to Embodiment 2 is configured as a quilt including front cloth 11, back cloth 12, and padding 13, and metal fibers 2 bundled to be woolly are disposed as padding 13 between front cloth 11 and back cloth 12. In other words, woolly metal fibers 2 are packed between front cloth 11 and back cloth 12. Front cloth 11 and back cloth 12 are sewn with thread 14.

In radioprotective unwoven fabric 10, metal fibers 2 are a shield material shielding radioactive rays, and like Embodiment 1, for example, tungsten wires can be used as metal fibers 2. In this case, woolly metal fibers 2 are cottony tungsten wool.

As stated above, radioprotective unwoven fabric 10 according to Embodiment 2 is the quilt including front cloth 11, back cloth 12, and padding 13. In addition, metal fibers 2 are woolly and disposed as padding 13 of the quilt between front cloth 11 and back cloth 12.

As described above, the use of woolly metal fibers 2 as the shield material for radioactive rays makes it possible to achieve radioprotective unwoven fabric 10 that has a high shield factor and yet can be easily folded.

Moreover, woolly metal fibers 2 can be evenly spread all over by being packed. Furthermore, it is possible to reduce the degree of difficulty in downstream processing, by woolly metal fibers 2 being packed.

It should be noted that woolly metal fibers 2 are packed by quilting in Embodiment 2, the present disclosure is not limited to this.

Variations

Although the radioprotective unwoven fabrics according to the present disclosure have been described based on the aforementioned embodiments, the present disclosure is not limited to the aforementioned embodiments.

For example, in the aforementioned embodiments, fiber products including the radioprotective unwoven fabrics are not limited to products wore by people, and may be products other than the products worn by the people, and the radioprotective unwoven fabrics is not limited for use in fiber products, and can be for use in products other than the fiber products.

Moreover, the radioprotective unwoven fabrics are not limited to commercial products, and may be industrial products. For example, the radioprotective unwoven fabrics can be used as filters.

In particular, the radioprotective unwoven fabrics according to the aforementioned embodiments have superior thermal resistance, and thus can be used as filters in a high-temperature environment. Moreover, since the radioprotective unwoven fabrics according to the aforementioned embodiments each include only the metal fibers and do not include an organic material such as a resin, the radioprotective unwoven fabrics according to the aforementioned embodiments can be used as chemical filters that transmit an acid solution, an alkaline solution, or the like.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A radioprotective unwoven fabric, which is a sheet in which metal fibers are three-dimensionally and randomly stacked, the metal fibers each comprising a metal material having a specific gravity higher than a specific gravity of lead, wherein the metal fibers make up the radioprotective unwoven fabric, and each of the metal fibers consists of metal wire.

2. The radioprotective unwoven fabric according to claim 1, wherein the metal fibers comprise a tungsten wire.

3. The radioprotective unwoven fabric according to claim 2, wherein the metal fibers further comprise a molybdenum wire.

4. The radioprotective unwoven fabric according to claim 1, wherein the metal fibers are only tungsten wires.

5. The radioprotective unwoven fabric according to claim 1, which is felt.

6. The radioprotective unwoven fabric according to claim 1, wherein each of the metal fibers is not a monofilament.

7. The radioprotective unwoven fabric according to claim 1, wherein each of the metal fibers has a diameter of at most 1 mm and a length of at least 20 mm and at most 80 mm.

8. A fiber product, which is obtained by sewing the radioprotective unwoven fabric according to claim 1.

9. A radioprotective product, which is a quilt including a front cloth, a back cloth, and padding including metal fibers and disposed between the front cloth and the back cloth, wherein the metal fibers are three-dimensionally and randomly stacked, the metal fibers each comprise a metal material having a specific gravity higher than a specific gravity of lead, and the metal fibers are woolly and make up the radioprotective unwoven fabric, and each of the metal fibers consists of metal wire.

10. The radioprotective product according to claim 9, wherein the metal fibers comprise a tungsten wire.

11. The radioprotective product according to claim 10, wherein the metal fibers further comprise a molybdenum wire.

12. The radioprotective product according to claim 9, wherein the metal fibers are only tungsten wires.

13. The radioprotective product according to claim 9, wherein each of the metal fibers is not a monofilament.

14. The radioprotective product according to claim 9, wherein each of the metal fibers has a diameter of at most 1 mm and a length of at least 20 mm and at most 80 mm.

* * * * *